United States Patent [19]

Alexandre, Jr.

[11] 3,956,862

[45] May 18, 1976

[54] BUILDING SYSTEM

[76] Inventor: Joao Alexandre, Jr., 30 Jamaica Way, No. 2, Boston, Mass. 02130

[22] Filed: May 27, 1975

[21] Appl. No.: 581,312

Related U.S. Application Data

[63] Continuation of Ser. No. 458,198, April 5, 1974, abandoned.

[52] U.S. Cl. ..... 52/286; 52/396; 52/574; 52/589; 52/590

[51] Int. Cl.[2] ..... E04B 1/00; E04C 1/10

[58] Field of Search ..... 52/285, 286, 594, 590, 52/593, 271, 589, 574

[56] References Cited

UNITED STATES PATENTS

| | | | |
|---|---|---|---|
| 1,514,081 | 11/1924 | Hahn | 52/285 |
| 1,686,757 | 10/1928 | Loughridge | 52/589 |
| 3,355,849 | 12/1967 | Hancock | 52/574 |

FOREIGN PATENTS OR APPLICATIONS

| | | | |
|---|---|---|---|
| 622,936 | 7/1961 | Italy | 52/590 |
| 289,917 | 4/1953 | Switzerland | 52/286 |

*Primary Examiner*—Ernest R. Purser
*Assistant Examiner*—Robert Farber
*Attorney, Agent, or Firm*—Cesari and McKenna

[57] ABSTRACT

A building system uses preformed blocks which are specially designed so that they key together when stacked to resist lateral movement and thus form a sturdy, load-bearing wall which does not require any mortar. In addition to a standard block, the system includes keyable corner and partition blocks as well as a cap block to provide appropriate smooth borders for windows, doors and the like.

4 Claims, 4 Drawing Figures

BUILDING SYSTEM

This is a continuation of application Ser. No. 458,198 filed Apr. 5, 1974, now abandoned.

BACKGROUND OF THE INVENTION

This invention relates to a building system. It relates more particularly to a building system using preformed blocks which require no mortar in order to position them to form a building structure.

Because of ever-increasing building costs, it is imperative that new techniques be developed to reduce the cost of building materials and to reduce the cost of the labor required to assemble these materials into a finished structure.

One way of accomplishing this is by dispensing with the various different building components such as studs, siding, etc. which have to be fitted and secured together to form a building wall and replacing them with a single type of preformed, load-bearing unit. The well-known cinder block is an example of such a unit and strong load-bearing walls can be constructed using cinder blocks.

A major disadvantage of cinder block construction stems from the fact that the blocks have to be mortared together to form the finished structure. Otherwise, lateral forces on the blocks will tend to move the blocks relative to one another and might cause collapse of the building. Not only does the required use of mortar increase the cost of materials and labor for the building, it also means that one must rely on a skilled mason in order to erect buildings of this type.

In many localities, particularly in underdeveloped countries, persons with such skills are not very plentiful. Moreover, in the same localities, it may be quite difficult to obtain the requisite quantity of mortar and transport it to the building site. All of these factors make it extremely difficult for the average person to build a house, for example, using presently available building techniques.

Conventional mortared block building systems are disadvantaged also because it takes many hours for the mortar to set to the point where the blocks cannot move relative to one another. Consequently, staging or scaffolding capable of supporting a man's weight is required in order to build even a moderately high mortared wall of this type, thereby adding to the construction cost and complexity.

SUMMARY OF THE INVENTION

Accordingly, the present invention aims to provide a building system which should substantially decrease the cost of erecting structures of both the residential and commercial types.

Another object of the invention is to provide a building system which is comprised of standard building units to decrease materials costs.

Yet another object of the invention is to provide a building system whose building units do not have to be permanently held together with mortar, pins or other such physical connections.

A further object of the invention is to provide a building system composed of standard building units which can be assembled by unskilled people to form a finished structure.

A further object of the invention is to provide a standard building unit which can be assembled with other similar units to form a load-bearing wall or structure without any permanent connection between the individual building units.

Yet another object of the invention is to provide an improved preformed building block.

Other objects will in part be obvious and will in part appear hereinafter.

The invention accordingly comprises the features of construction, combination of elements and arrangement of parts which will be exemplified in the following detailed description and the scope of the invention will be indicated in the claims.

In general, my building system is comprised of an array of preformed structural units which are stacked together to form the walls of the structure. The structural units or blocks are specially shaped and dimensioned so as to key with one another. Consequently, although there is no securement between the individual blocks, they cooperate with one another to produce a rigid, load-bearing wall.

The standard structural unit is a preformed block of concrete or other comparable material able to withstand compression forces. Each block is generally frustopyramidal in shape. That is, in elevation, the body is shaped more or less like a trapezoid and, from the top and bottom, it appears generally rectangular. One inclined side wall of the body has an outwardly projecting wedge-shaped key which is arranged to fit in a correspondingly shaped keyway in an adjacent block. On the other hand, the other side edge of the block has a keyway which is arranged to receive a similarly shaped key of an adjacent block.

The top and bottom walls of the block also have a specially shaped key and keyway, respectively. More particularly, the top wall has an upwardly projecting roof-shaped key extending along its longitudinal center line. Midway along that key are a pair of laterally projecting, semicylindrical keys extending from the center line of the block to its front and rear edges. The female counterparts of the aforesaid wedge-shaped and semicylindrical keys are formed in the bottom face of the block. These elements are arranged to interlock with similar key and keyways formed in the blocks above and below the one in question.

The key and keyway shapes and surface angles are arranged so that when a number of these blocks are stacked side-by-side and in courses, each block interlocks with adjacent blocks to render the resultant structure quite rigid and completely self-supporting.

As will be described in more detail later, modifications of the standard block are used to form the corners, partitions and window and door frames in the resultant structure. Also, if desired, the resultant structure can be further strengthened if local building codes require this by installation of appropriate reinforcing rods at the corners and at selected locations throughout the structure.

Thus, by using a standard, specially design, preformed building block, plus a few modifications of that basic building block, one can construct retaining walls and partitioned buildings of both residential and commercial varieties, without using any mortar and without any special tools or equipment. One simply stacks a number of the basic blocks side-by-side and in courses to create the necessary walls and partitions.

Since the building system is completely self-supporting, the builder can stand on the blocks in one course while he is adding blocks to the next higher course. Thus, no special scaffolding or staging is required during the construction phase. This also means that the builder does not have to be a skilled construction worker or mason in order to erect a building of this type and special tools and materials do not have to be transported to the building site which, in many cases, may be in a rather inaccessible location.

All of these features make the present building system a particularly useful and desirable building tool, particularly in these times when construction costs are so high and skilled labor is in such short supply.

BRIEF DESCRIPTION OF THE DRAWING

For a fuller understanding of the nature and objects of the invention, reference should be had to the following detailed description taken in connection with the accompanying drawing, in which.

DESCRIPTION OF THE PREFERRED EMBODIMENT

Figure 1:
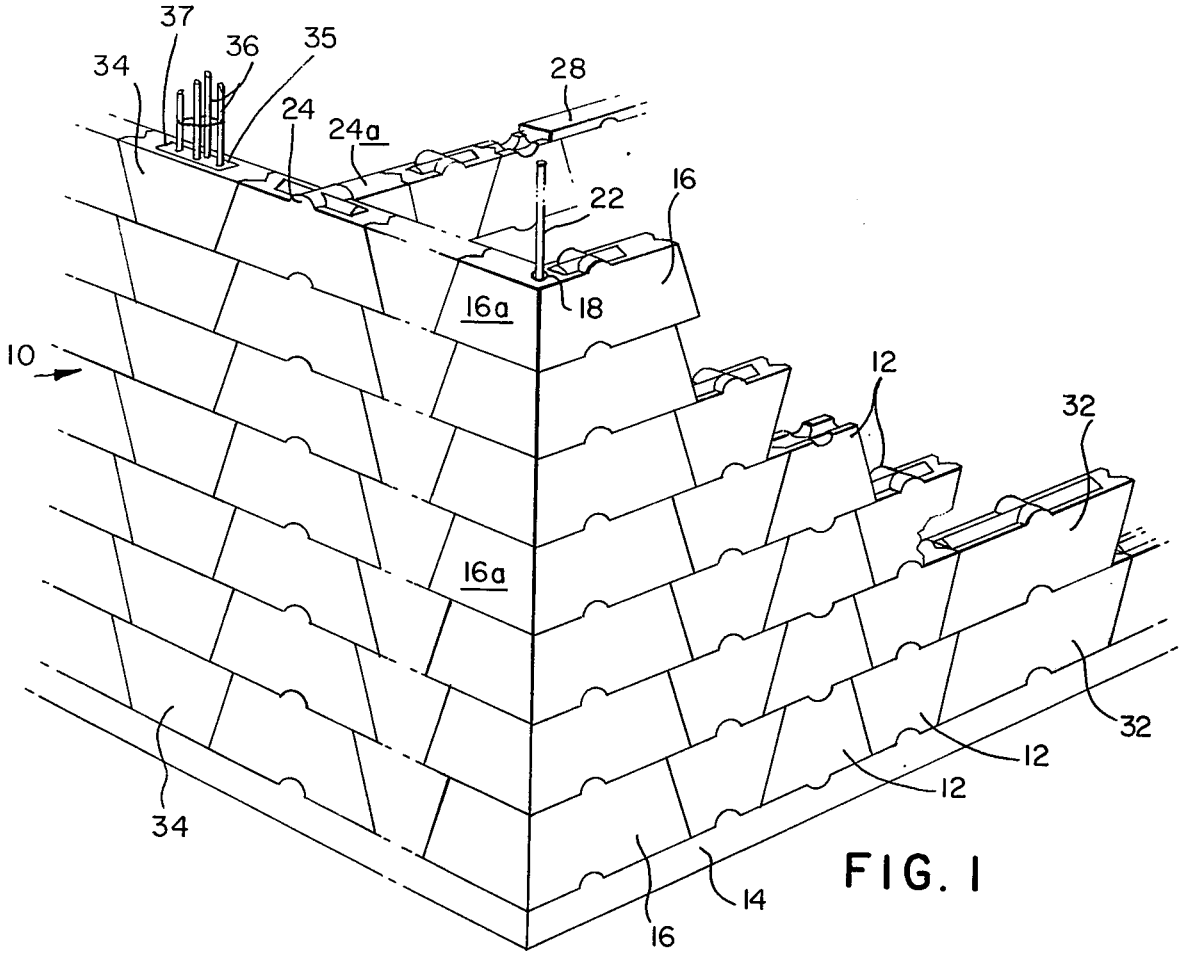
FIG. 1 is a fragmentary perspective view of a building constructed in accordance with the present invention.

Turning now to FIG. 1 of the drawing, the building indicated generally at 10 is constructed of a number of basic, specially shaped, preformed building units or blocks 12 which are stacked side-by-side and on top of one another in courses. The bottom course of the block is preferably placed on a suitable slab 14 of concrete or the like.

If concrete is not available and a strong building surface is required, a very strong pad can be provided by nesting a number of the basic building blocks 12 side-by-side to form the slab 14.

Still referring to FIG. 1, the blocks 12 in the first course above slab 14 are arranged side-by-side with adjacent blocks being inverted. As depicted in that figure, the blocks are specially shaped so as to nest and key together so that there is essentially no gap between them.

To form the corners of the building 10, a modified version of the basic block is used and is indicated by the numeral 16. The corner block 16 is similar to the block 12 except that it has a leg 16a extending at right angles to the remainder of the block, giving the overall corner unit a generally L-shaped configuration.

Also, the corner block 16 is desirably formed with a vertical passage 18 at its corner so that when the structure is completed, a reinforcing rod 22 can be passed down through the holes 18 in the entire corner column of blocks 16 to provide additional structural rigidity if local conditions require this. Suitable concrete grout or other such filler material is poured into openings 18 to fill the space between rods 22 and the sides of the openings 18 and to anchor the rods in place.

The second modification of the basic building block shown at 24 may be used to join partitions to the basic building shell. Block 24 is similar to block 12, except that it has a centrally located leg 24a extending at right angles to its longitudinal center line, giving the overall block a generally T-shaped appearance.

To finish or cap off the structure at the top and around doors, windows and the like, suitable cap blocks are provided which interlock with the exposed surfaces of the building blocks 12, 16 and 24. A typical cap of this type is illustrated at 28 in FIG. 1. Generally, its exposed surfaces are smooth and rectangular, while the hidden surfaces conform to the surfaces of the block 12, 16 or 24 against which it is placed.

Also, to minimize the number of separate building units required in a particular structure, the building block 12 can be preformed so that it is twice as long, so long as the basic geometrical arrangements of its keys and keyways are not upset. Two such elongated blocks are shown at 32 in FIG. 1. Since each block 32 is basically two blocks 12 joined end-to-end, the overall block 32 has the shape of a regular parallelopiped and each block 32 occupies the space of two blocks 12 nested side-by-side.

In some situations, it may be desirable to provide additional reinforcement when the structure is to be used for applications where an appreciable sideways force is applied to the building walls. This may occur, for example, if the building is used to store a large amount of grain. In the present system, this is accomplished by forming a number of the blocks 12 as hollow tubes and arranging them in a column as shown at 34 in FIG. 1. These tubular blocks 34 are then stacked one on top of the other so as to form a relatively large passage 35 extending all the way from the top of the structure down to slab 14. A plurality, say, four, steel reinforcing rods 36 can be passed down through the passage 35 in blocks 34. Finally, concrete can be poured into the passage 35 around the rods to completely fill the openings in blocks 34 as shown at 37 and provide an extremely strong, rigid, reinforcing pier integral with the wall of the building. Alternatively, conventional forms can be placed on each side of the wall adjacent rods 36 and concrete poured between the forms to provide a continuous vertical pier through the entire wall thickness.

Figure 2:
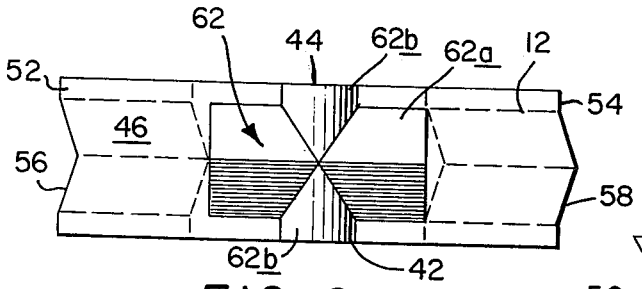
FIG. 2 is a top plan view of a basic building block used to construct the FIG. 1 structure.
Figure 3:
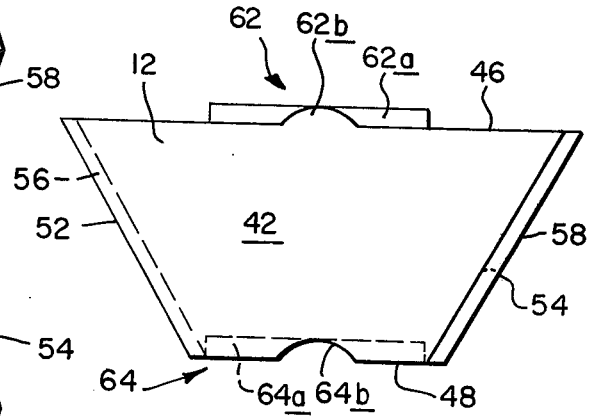
FIG. 3 is a side elevational view of the FIG. 2 block.
Figure 4:
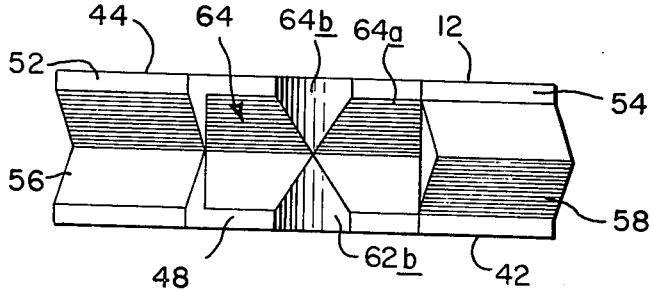
FIG. 4 is a bottom view thereof.

Turning now to FIGS. 2–4, the basic building block 12 is molded of concrete aggregate or other comparable substance. The block is preferably solid, although it may have openings more or less like a cinder block. The block is generally frustopyramidal in shape in that its front and rear walls 42 and 44, respectively, are flat, parallel and, in elevation, trapezoidal in shape, while the top and bottom walls 46 and 48 are generally rectangular. The two inclined side walls 52 and 54 of the block are formed with a mating keyway 56 and key 58. The key and keyway are generally wedge-shaped with the apex of the wedges being coincident with the longitudinal medial plane of the block.

As best seen in FIG. 1, two blocks 12 are placed adjacent one another with alternate blocks being inverted as shown in FIG. 1. Key 58 of one block interlocks with the keyway 56 in the adjacent block in the course, thereby preventing relative lateral movement between the blocks. The interlocking key and keyways of adjacent blocks also makes a relatively close-fitting joint between adjacent blocks to exclude the elements, dust, insects and the like that may be present at the building site.

As best seen in FIGS. 2 and 3, the top wall or surface 46 of each block 12 has a specially shaped key formed thereon which is shown generally at 62. Key 62 includes a longitudinal wedge-shaped portion 62a which is symmetric with the longitudinal center line of the block and projects up from the block more or less like the roof of a house. The key portion 62a extends along the top of the block so that one of its ends is located directly above the lower end of keyway 52 at the apex thereof and its other end is positioned directly above the lower end of key 54 at the root thereof.

Key 62 also includes a pair of laterally extending, semicylindrical portions 62*b* which extend out from the middle of portion 62a more or less like the roof gables. As best seen in FIGS. 2 and 3, the intersection of the two key portions 62*b* is located precisely at the center of the block top wall 46.

Referring now to FIGS. 3 and 4, the block bottom wall 48 is formed with a keyway shaped and arranged to receive the key 62 of an underlying block 12. That is, the keyway shown generally at 64 has a longitudinal, wedge-shaped portion 64*a* and a pair of laterally extending semicylindrical portions 64*b* which extend out from the midpoint of portion 64*a*. When one block 12 is placed on top of a second block 12, as shown in FIG. 1, the key 62 of the lower block is snugly received in the keyway 64 of the upper block, forming a tight, weatherproof joint between them.

The wedge-shaped key and keyway portions 62*a*,64*a* prevent two blocks from moving laterally relative to one another, while the semicylindrical portions 62*b*,64*b* prevent relative movement of the two blocks in the longitudinal direction. Furthermore, since the two key/keyway portions are disposed at right angles to one another, the two interlocking blocks are able to withstand twisting and racking forces.

Thus, the geometry of the basic building unit is precisely designed to permit a number of these blocks to be arranged in tiers and courses to produce a very rigid structure which is able to withstand lateral and longitudinal forces that are likely to be imposed upon it during normal use and occupancy of the structure.

The corner blocks 16, partition blocks 24, caps 28 and double blocks 32 shown in FIG. 1 have similar arrangements of keys and keyways which allow them to interlock with the basic building units 12 and with each other.

It will be seen from the foregoing, then, that the utilization of a standard building unit of the precisely designed geometrical configuration disclosed herein results in a building system having a minimum number of different parts and which requires no mortar or other permanent physical connection between the individual building units.

The structure made in accordance with the present invention is load-bearing from its inception so that it can withstand the weight of the builder as he adds additional blocks to increase the height or size of the structure. Further, as the building system requires no special tools, equipment or special skills, an unskilled person can erect most present-day types of building structures.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described.

I claim:

1. A building system comprised of a number of identical preformed basic building units, each said building unit comprising a rigid block having a first pair of parallel horizontal walls, a second pair of parallel vertical walls and a third pair of walls, said third wall pair being oriented obliquely with respect to at least one of the other two wall pairs, means defining a single key having a generally triangular cross section in one of said oblique walls and means defining a matching keyway in the other of said oblique walls, said key and keyway extending along the longitudinal center lines of the oblique walls and occupying substantially the entire oblique walls, means defining a second key in one wall of said horizontal wall pair and means defining a second matching horizontal keyway in the other wall of said horizontal wall pair, said second key and keyway each including a first generally wedged-shaped portion which extends only partway along the longitudinal center line of its corresponding wall but across substantially its entire width and a second generally semicylindrical portion which is oriented perpendicular to the first portion and extends from the block center line to the opposite vertical walls of the block so that a number of said blocks can be stacked side-by-side and in courses with the adjacent blocks in each course being inverted relative to one another so as to interlock with one another to form a rigid, load-bearing structural unit.

2. A building unit comprising a rigid block having a first pair of parallel horizontal walls, a second pair of parallel vertical walls and a third pair of walls, said third wall pair being oriented obliquely with respect to at least one of the other two wall pairs, means defining a single key having a generally triangular cross-section in one of said oblique walls and means defining a matching keyway in the other of said oblique walls, said key and keyway extending along the longitudinal center lines of the oblique walls and occupying substantially the entire oblique walls, means defining a second key in one wall of said horizontal wall pair and means defining a second matching horizontal keyway in the other wall of said horizontal wall pair, said second key and keyway each including a first generally wedge-shaped portion which extends only partway along the longitudinal center line of its corresponding wall but across substantially its entire width and a second generally semicylindrical portion which is oriented perpendicular to the first portion and extends from the block center line to the opposite vertical walls of the block so that a number of said blocks can be stacked side-by-side and in courses with the adjacent blocks in each course being inverted relative to one another so as to interlock with one another to form a rigid, load-bearing structural unit.

3. The system defined in claim 1 and further including means defining a passage extending through the block connecting the walls thereof containing the second key and keyway so the when a number of said blocks are stacked one on top of the other, the passages in the several blocks form an extended vertical passage for receiving reinforcing means.

4. The system defined in claim 3 and further including at least one reinforcing rod coextensive with said extended passage, and a hardenable material filling the space between the rod and the extended passage wall.

* * * * *